US008615948B2

(12) United States Patent
Underkofler et al.

(10) Patent No.: US 8,615,948 B2
(45) Date of Patent: Dec. 31, 2013

(54) SEISMIC PERIMETER BRACE

(75) Inventors: Abraham M. Underkofler, Waukegan, IL (US); Peder J. Gulbrandsen, Aurora, IL (US); Mark R. Paulsen, Waukegan, IL (US); James J. Lehane, McHenry, IL (US); Lee M Tedesco, Shorewood, IL (US)

(73) Assignee: USG Interiors, LLC, Chicago, IL (US)

( * ) Notice: Subject to any disclaimer, the term of this patent is extended or adjusted under 35 U.S.C. 154(b) by 208 days.

(21) Appl. No.: 12/782,119

(22) Filed: May 18, 2010

(65) Prior Publication Data

US 2011/0283634 A1 Nov. 24, 2011

(51) Int. Cl.
*E04B 9/22* (2006.01)
*E04C 2/42* (2006.01)

(52) U.S. Cl.
USPC ..... 52/506.07; 52/506.06; 52/506.08; 52/665

(58) Field of Classification Search
USPC ..... 52/506.1, 506.06, 506.07, 506.08, 509, 52/511, 712, 289, 702, 665, 668; 248/342, 248/343, 344; 403/217, 382, 403
See application file for complete search history.

(56) References Cited

U.S. PATENT DOCUMENTS 4,572,695 A * 2/1986 Gilb ..... 403/232.1
4,715,161 A * 12/1987 Carraro et al. ..... 52/714
5,046,294 A * 9/1991 Platt ..... 52/506.06
6,018,923 A * 2/2000 Wendt ..... 52/712
6,029,414 A * 2/2000 MacLeod ..... 52/506.07
6,446,409 B1 * 9/2002 Emerson ..... 52/712
7,293,393 B2 * 11/2007 Kelly et al. ..... 52/665
7,552,567 B2 * 6/2009 Ingratta et al. ..... 52/506.07
7,634,889 B1 * 12/2009 diGirolamo et al. ..... 52/712
7,930,864 B2 * 4/2011 Wendt ..... 52/712
D638,287 S * 5/2011 Tedesco et al. ..... D8/394
2001/0032433 A1 * 10/2001 Harris ..... 52/506.06
2005/0160696 A1 * 7/2005 Kelly et al. ..... 52/712
2010/0005747 A1 * 1/2010 Tedesco et al. ..... 52/506.08

* cited by examiner

*Primary Examiner* — James Buckle, Jr.

(74) *Attorney, Agent, or Firm* — Pearne & Gordon LLP

(57) ABSTRACT

A seismic bracket for supporting ends of suspended ceiling grid runners from a wall comprising a stamped sheet metal body, the body having a horizontally extending portion and a vertically extending portion, the vertically extending portion, in its installed position, rising above the top of a standard grid runner a distance at least 1½ times the height of such standard grid runner, the vertically extending portion having two sections generally coextensive in the vertical direction, a first section being integral with the horizontally extending portion and a second section arranged to be in a vertical plane that intersects a vertical plane occupied by the horizontally extending portion, the horizontally extending portion being arranged to support a grid runner to move longitudinally a limited distance, the second section of the vertically extending portion having an aperture for securing the bracket to the wall at a location substantially above the grid tee.

5 Claims, 6 Drawing Sheets

SEISMIC PERIMETER BRACE

BACKGROUND OF THE INVENTION

The invention relates to suspended ceiling grid construction and, in particular, to a bracket for supporting peripheral ceiling grid runners from adjacent wall structure.

PRIOR ART

Geographic regions prone to or predicted to experience seismic events can benefit with construction elements that reduce the effects of these occurrences. In this context, suspended ceiling grids have been provided with various expedients to accommodate a sudden structural shift or series of shifts of limited amplitude and maintain sufficient integrity to keep ceiling panels carried on the grid from falling. There remains a need for a simple, quick, and effective way of supporting grid runners at the perimeter of a suspended ceiling apart from the standard wall angle. Often, the plenum above the ceiling adjacent its perimeter is occupied by utilities such as air ducts, electrical raceways and the like. These utilities and other objects can make it difficult to support the ends of grid runners or tees at these locations with suspension wire from above, for example.

SUMMARY OF THE INVENTION

The invention provides a novel bracket particularly useful in higher seismic category geographic zones where suspended ceiling grid tees or runners are to be supported in close proximity to a wall other than by a conventional wall angle. Brackets of the invention, sometimes referred to as braces, can eliminate the need for suspension wires at the perimeter of a ceiling. Such wires can be difficult to install and, therefore, expensive for lack of conveniently accessible superstructure.

The inventive bracket, capable of being produced with various profiles, is preferably formed as a sheet metal stamping. The bracket can be marketed in a substantially two dimensional configuration and be bent as it is installed to suit the geometry of the grid and wall intersections. In general, the bracket body includes a saddle-like portion that extends horizontally over a grid runner and a vertically extending portion above the plane of the grid runner adapted to be fastened to a wall.

Ideally, the bracket optionally provides limited horizontal movement of the grid runner or a rigid connection of the grid runner to the wall. Horizontal movement is achieved with a slot in the bracket body that lies alongside a part of the grid runner and receives a fastener extending through the grid runner. Alternatively, the horizontal movement is accommodated by a depending pivotal arm integral with the bracket body. One part of the vertically extending portion is anchored flat against a surface of the wall at the boundary of the ceiling and another part of the vertically extending portion serves as a web between the wall anchored part and the horizontally extending portion of the bracket. The two parts of the vertically extending portion can be connected at a bend line defined by a zone weakened with a series of aligned apertures or slots in the sheet metal body. This construction permits the bracket to be bulk shipped in a "flat" configuration to occupy relatively small volume and be custom bent at the installation site by the installer to fit the intersection geometry of the ceiling grid and the wall especially if it is other than 90°.

DESCRIPTION OF THE PREFERRED EMBODIMENTS

Figure 1:
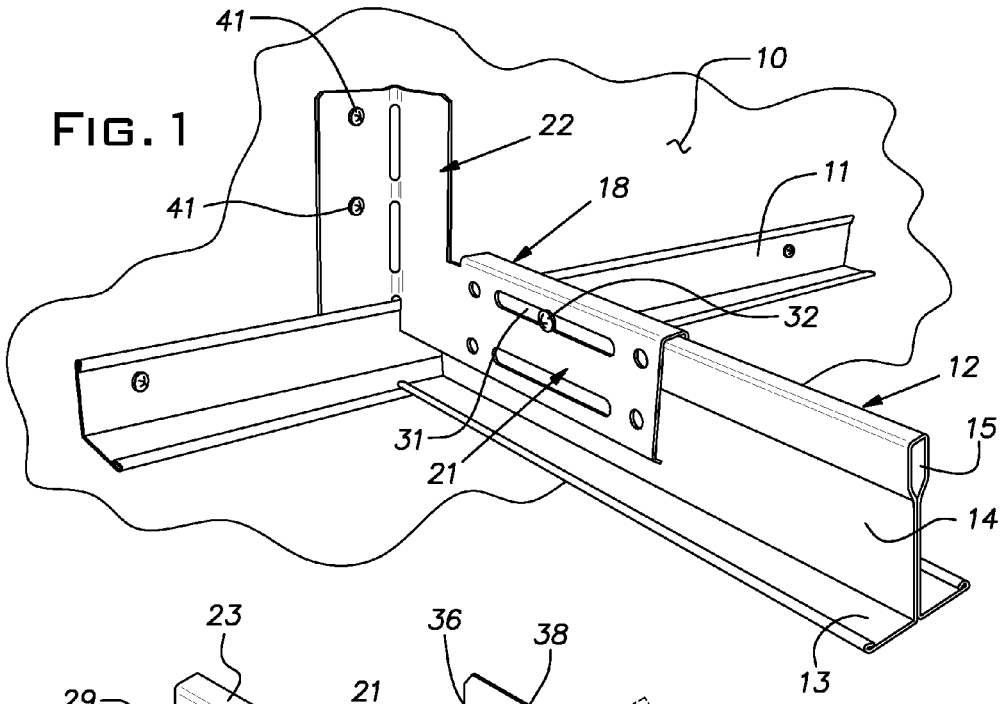
FIG. 1 is a fragmentary perspective view of a perimeter area of a suspended ceiling grid illustrating a first embodiment of the invention.
Figure 2:
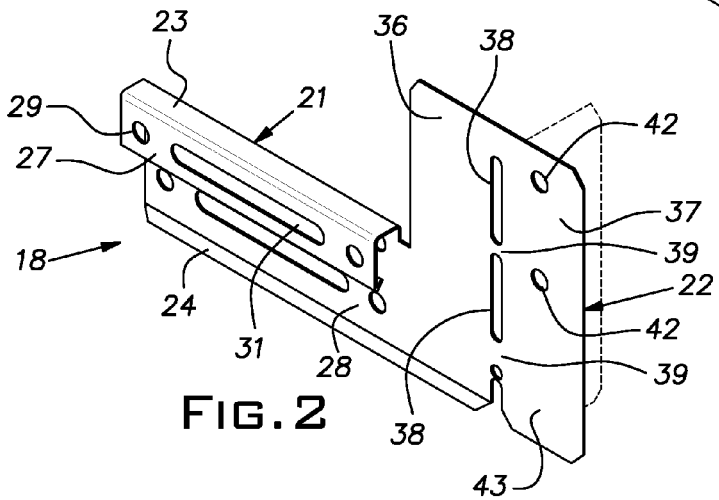
FIG. 2 is a perspective view of a bracket of the first embodiment of the invention.

Referring now to the drawings and, in particular, to FIGS. 1-4, there is illustrated a vertical rigid wall 10 on which a conventional suspended ceiling wall angle 11 is mounted by suitable fasteners such as screws. The wall angle 11, conventionally roll-formed of sheet metal, lies at the perimeter and plane of a suspended ceiling grid represented by a grid runner or tee 12 of conventional construction. The grid runner 12, ordinarily of roll-formed sheet metal, has the general cross-section of an inverted T with a lower horizontal flange 13, vertical central web 14, and an upper polygonal hollow reinforcing bulb 15.

Typically, the wall angle 11 in several pieces is placed end-to-end to run along each wall surrounding the ceiling grid. Grid runners 12 are ordinarily spaced apart on two or four foot centers (or metric equivalent). In some categories of seismic rated geographic areas, it can be desired to support the peripheral grid runners 12 within 8" of a wall 10. Often, the plenum above the plane of the ceiling is crowded with utilities in spaces adjacent the walls 10 making it difficult and time-consuming and, therefore expensive if not impractical to use conventional hanger wires in these spaces.

The invention provides a bracket or brace 18 adapted to support the end of a grid runner 12 adjacent a wall 10 or similar structure at the edge or periphery of the ceiling. While FIG. 1 illustrates only one grid runner or tee 12, it will be understood that it is representative of numerous tees uniformly spaced from one another along the wall 10 and a separate bracket 18 is provided for each tee. The bracket 18, and other versions depicted in FIGS. 5-18 to be described, are preferably sheet metal stampings of, for example, 0.024" gauge steel. The bracket 18 includes a horizontally extending portion shown generally at 21 and a vertically extending portion shown generally at 22 which can be considered to overlap where they merge. The horizontally extending portion (sometimes simply "horizontal portion") 21 includes an inverted channel or saddle 23 giving the bracket 18 an inverted J-shaped cross-section shown in FIG. 3. A lower edge of the horizontal portion 21 has a small lengthwise extending flange 24. Opposite sidewalls 27, 28 are spaced apart to slip over the grid tee bulb 15. Typically, the bulb is ¼" wide (or metric equivalent). One of the channel sidewalls 28 extends vertically substantially below the opposite wall 27 such that when the bracket 18 is installed on a grid runner 12, it lies alongside the grid runner web 14. Both walls 27, 28 forming the channel 23 have holes 29 and a horizontally elongated slot 31 for receiving a screw or other fastener 32. The extended wall 28 has a second set of holes 33 and a horizontally elongated slot 34 below the first mentioned holes 29 and slot 31.

The vertically extending portion (sometimes simply "vertical portion") 22 of the bracket 18 has two sections or parts 36, 37 separated by a bend line made by a series of vertical aligned slots or apertures 38. The presence of the apertures 38 leaves small spaced land areas 39 which are relatively weak along the line of the apertures in resistance to bending the plane of one section 37 relative to the other 36. As a result, a low force, preferably even without hand tools applied by the installer is all that is required to locate the section 37 in a plane perpendicular or otherwise relative to the other section 36. Preferably, the bracket 18 is manufactured with both sections 36, 37 of the vertical portion 22 coplanar so that the bracket occupies a minimum space when packed and shipped with identical brackets 18. Weakening at the bend line allows the installer to ordinarily bend the section 37 to an angle corresponding to that at which the grid runner to which it is to be attached intersects the wall 10. While this angle is most often a right angle, it can be essentially any other angle.

Figure 3:
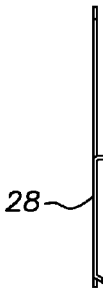
FIG. 3 is an end view of the bracket of FIGS. 1 and 2.
Figure 4:
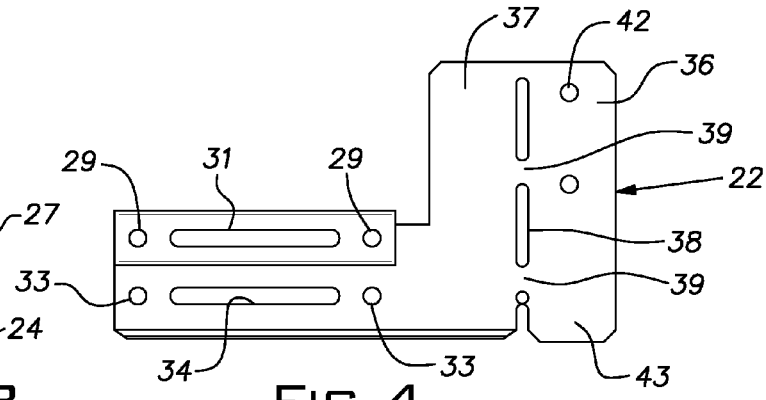
FIG. 4 is an elevational view of the bracket of FIGS. 1 and 2.

With reference to FIG. 3, it will be understood that the inverted channel 23 is dimensioned to seat on the sides and upper face as well as to support under one side of the bulb of a grid runner bulb 15 of a standard duty grid runner 12. The bracket 18 can be fixed to a grid runner 12 by assembling a screw 32 through the slot 31 (or the holes 29) and into the sidewall of the bulb 15. When the slot 31 is used, a limited longitudinal movement of the grid runner 12 relative to the bracket is accommodated. The lower flange 24 is proportioned to engage the grid runner web 14 and thereby assist in aligning and stabilizing the grid runner 12 to the bracket 18. A standard duty grid runner or tee 12 will measure nominally 1½" in height from the lower flange 13 to the top of the bulb 15. The lower holes 33 and slot 34 of the bracket 18 can be used, for instance, where the grid runner height is relatively short such as with a cross runner or cross tee. While a grid runner end rests on a wall angle 11, the bracket 18 can be installed by slipping the inverted channel 23 on the horizontal portion 21 down over the end of the grid runner so that the bulb 15 is received in the inverted channel 23. The bracket 18 is fastened to the wall 10 with screws or nails or other fasteners 41 assembled through holes 42 in the distal section 37 of the vertical portion 22. A lower area 43 of the distal section 37 can be slipped behind the vertical leg of the wall angle 11 or can be simply overlayed on this vertical leg.

Figure 5:
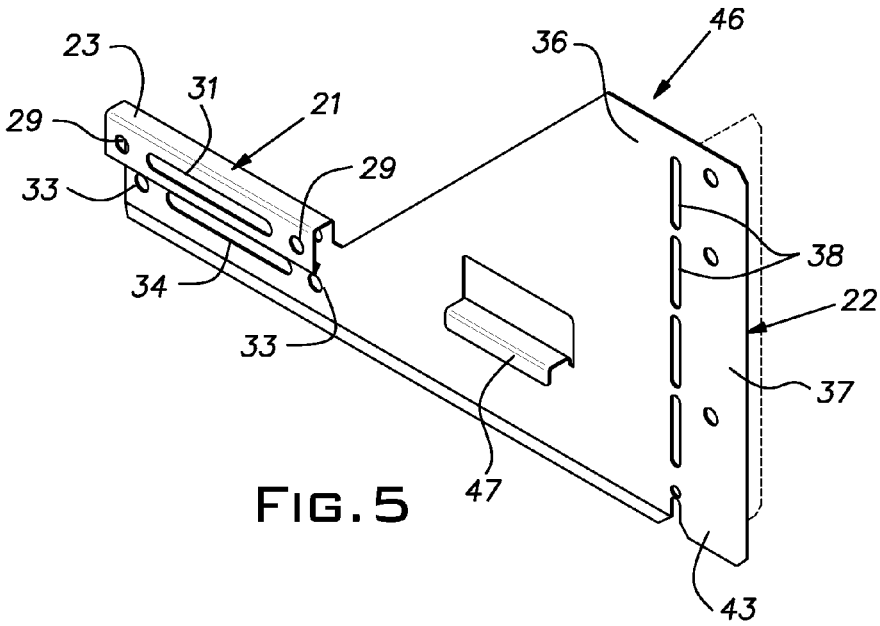
FIG. 5 is a perspective view of a bracket of a second embodiment of the invention.
Figure 6:
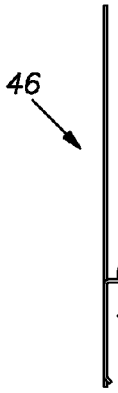
FIG. 6 is an end view of the bracket of FIG. 5.
Figure 7:
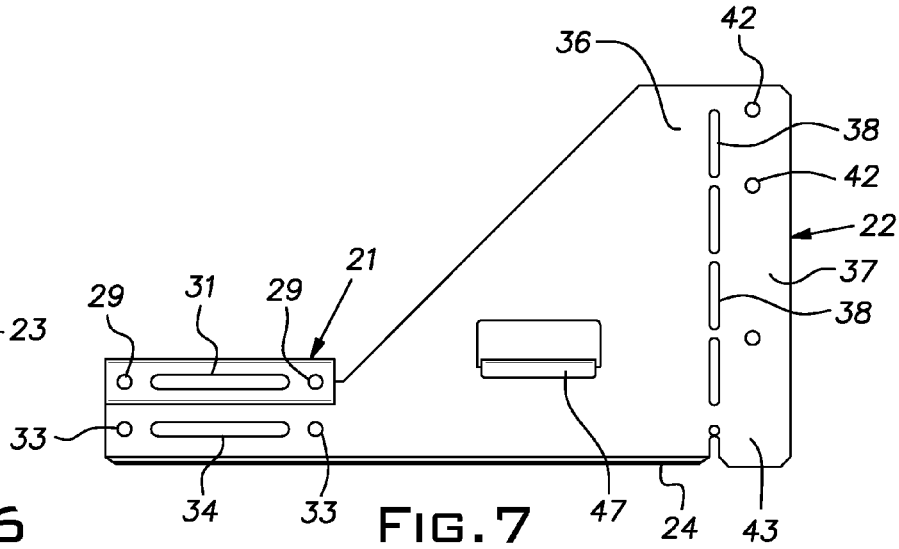
FIG. 7 is an elevational view of the bracket of FIG. 5.

In the variants of the bracket of the invention shown in FIGS. 5-19, equivalent or analogous elements of the version described with reference to FIGS. 1-4 are identified with the same numerals. Generally, like the first-described bracket 18, each of the other brackets shown in the subsequent figures are stamped of a suitable gauge of sheet steel. In FIGS. 5-7, the horizontal portion 21 of a bracket 46 is extended to enable a grid runner or tee 12 to be supported by the bracket at a greater distance from a wall 10 than that obtained by the bracket of FIGS. 1-4. The bracket 46 includes a second saddle-like inverted channel 47 aligned with and rearward of the channel 23. The channels 23 and 47 are each adapted to closely fit over three faces of a conventional grid runner bulb 15. In this version of the bracket 46, the vertical portion 22 has a height that is about ⅔ of the length of the horizontal portion 21 measured from the bend line formed by the slots 38.

Figure 8:
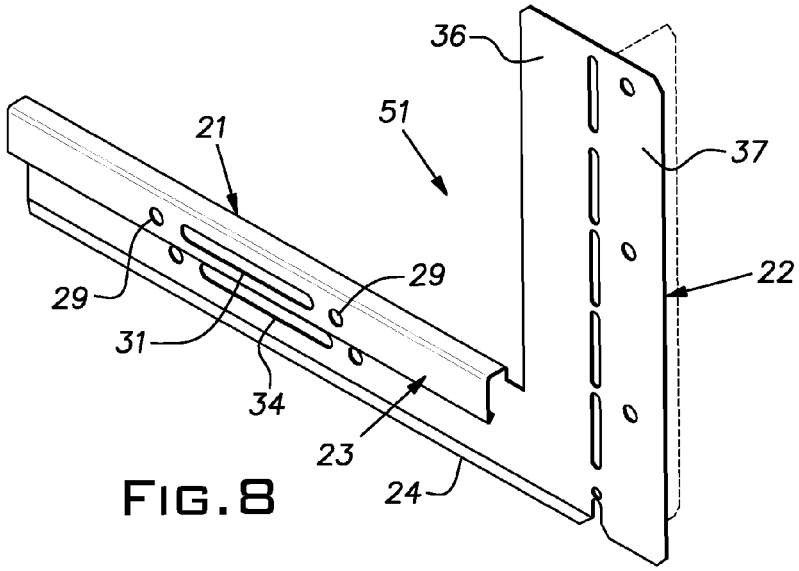
FIG. 8 is a perspective view of a bracket of a third embodiment of the invention.
Figure 9:
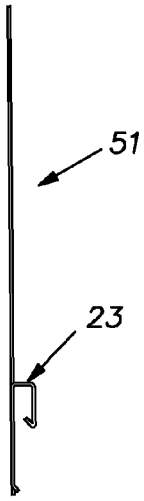
FIG. 9 is an end view of the bracket of FIG. 8.
Figure 10:
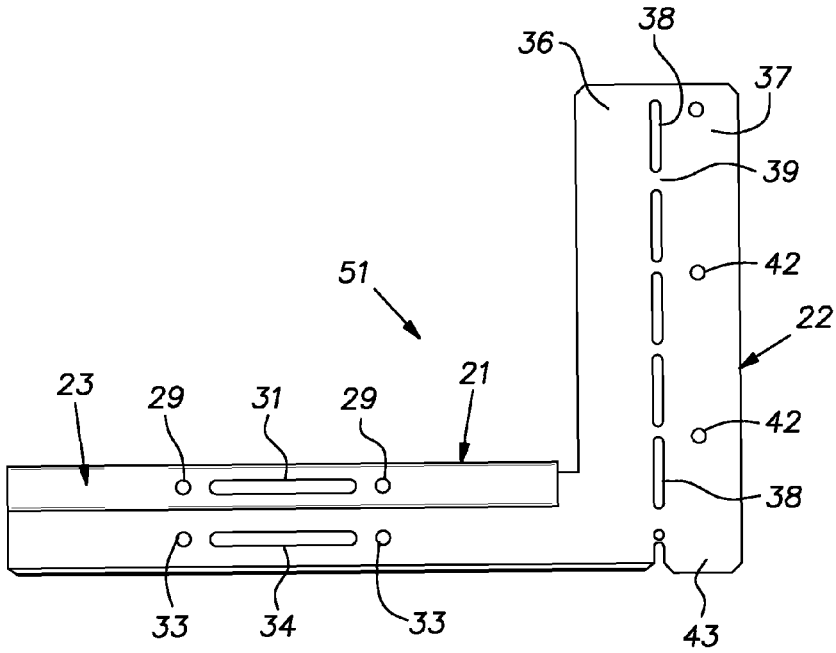
FIG. 10 is an elevational view of the bracket of FIG. 8.

Referring to FIGS. 8-10, a bracket 51, like the bracket 18, has an L-shape in elevational view. The length and height of the bracket 51 are increased from that of the first-described bracket 18. By way of example, the horizontal portion 21, measured from the line of the slots 38 to the distal end can be about 8" and the vertical portion can be about 7½" high.

Figure 11:
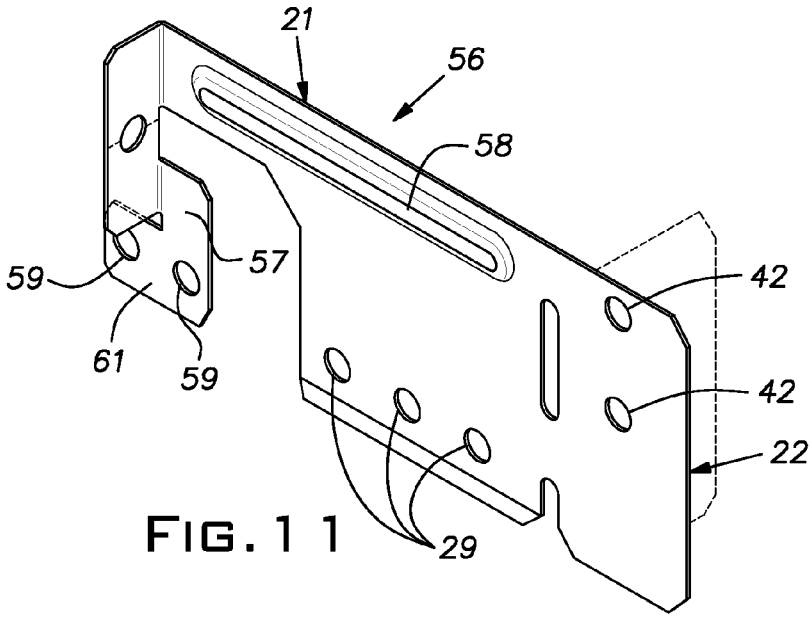
FIG. 11 is a perspective view of a bracket of a fourth embodiment of the invention.
Figure 12:
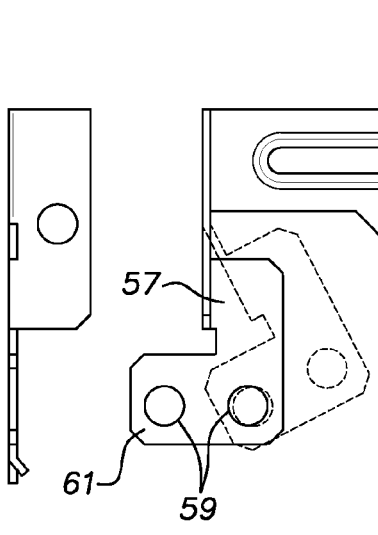
FIG. 12 is an end view of the bracket of FIG. 11.
Figure 13:
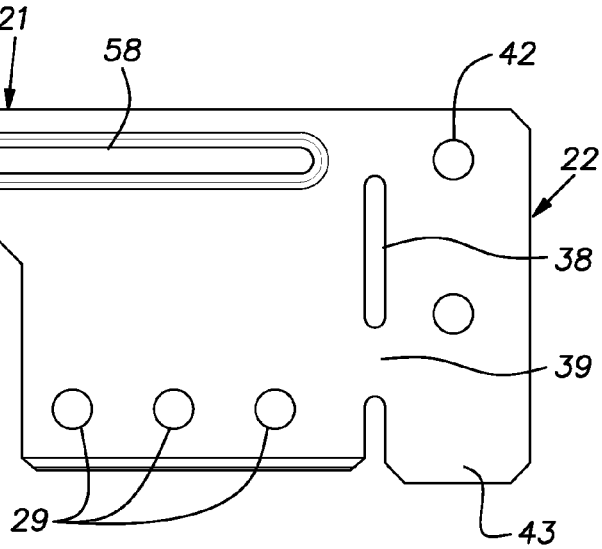
FIG. 13 is an elevational view of the bracket of FIG. 11.

FIGS. 11-13 illustrate a bracket 56 having a horizontal portion 21 with a depending pivotal leg 57. An elongated embossment 58 in the horizontal portion 21 stiffens the bracket 56. The leg 57 supports a tee for limited longitudinal motion as a substitute for the slot 31 found in other bracket versions. Either one of two holes 59 in an L-shaped tab 61 accepts a self-drilling screw that is driven into the bulb 15 of a grid runner or tee 12. The leg 57 can pivot either to the right, as shown in phantom in FIG. 13 or, similarly, to the left. When the grid runner 12 is displaced longitudinally, the tab 61 pivots on the screw fixing it to the bulb 15. In applications where the grid runner 12 is to be rigidly fixed relative to a wall, a screw is inserted in one or more of the holes 29 and driven into the bulb.

Figure 14:
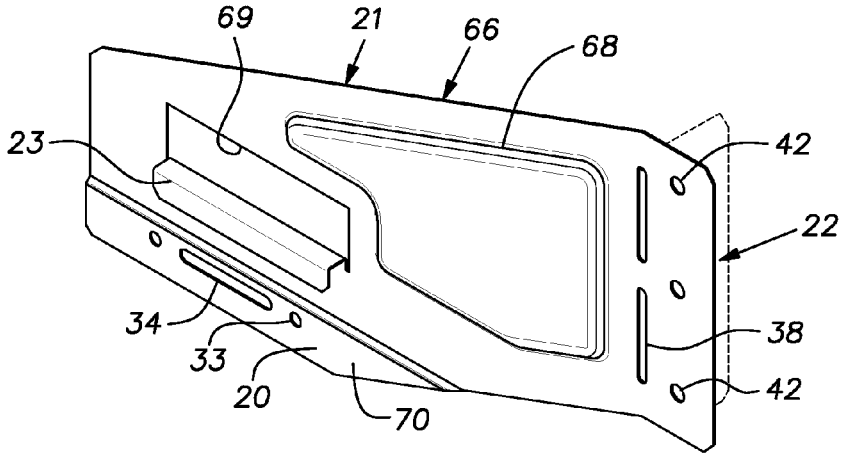
FIG. 14 is a perspective view of a bracket of a fifth embodiment of the invention.
Figure 15:
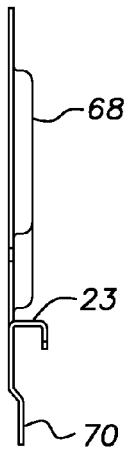
FIG. 15 is an end view of the bracket of FIG. 14.
Figure 16:
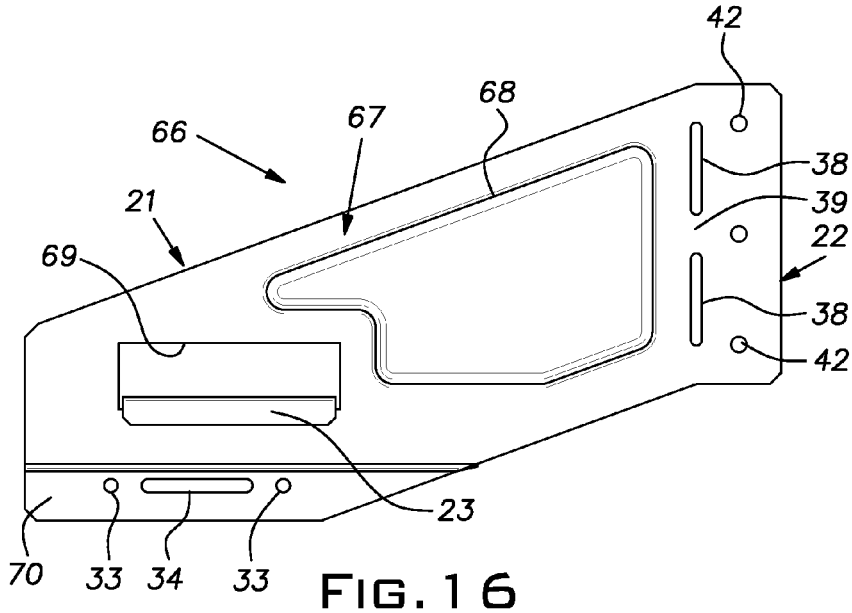
FIG. 16 is an elevational view of the bracket of FIG. 14.

FIGS. 14-16 depict a bracket where a gusset-like area 67 extends between the horizontal portion 21 and the vertical portion 22. The gusset-area 67 can have a polygonal embossment 68 generally following and inset from the profile of the bracket. Sheet material used to form the inverted channel 23 leaves a rectangular aperture 69 in the horizontal portion 21. A lower part 70 of the horizontal portion 21, which includes holes 33 and slot 34 is offset towards the center of the channel 23 to allow it to abut the web 14 of a grid runner 12.

Figure 17:
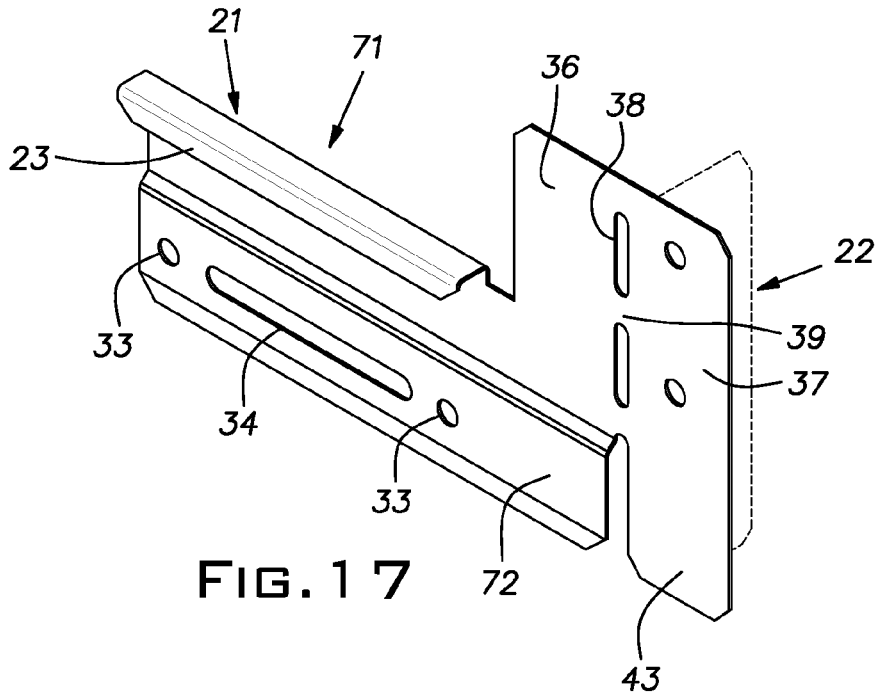
FIG. 17 is perspective view of a bracket of a sixth embodiment of the invention.
Figure 18:
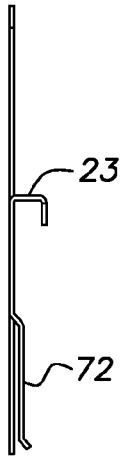
FIG. 18 is an end view of the bracket of FIG. 17.
Figure 19:
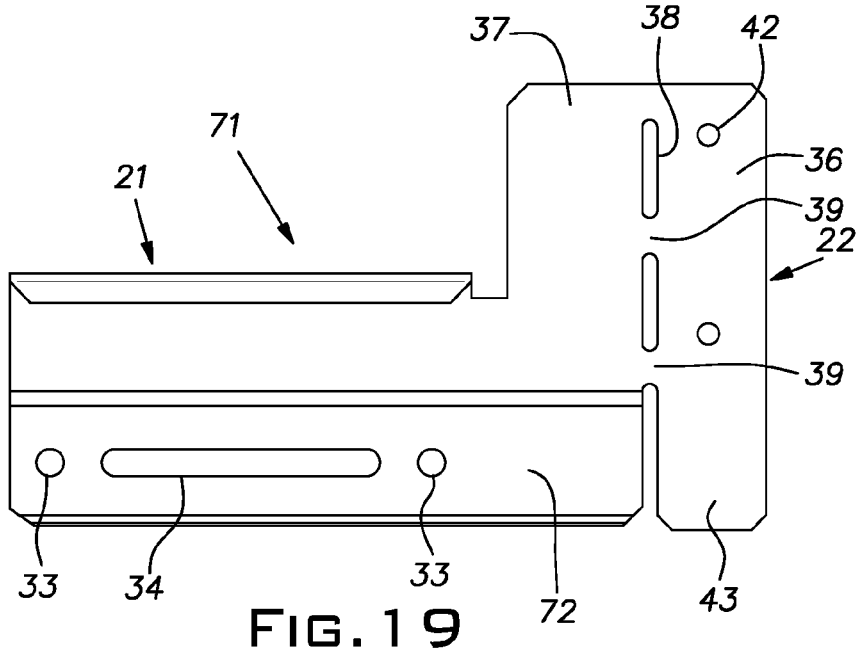
FIG. 19 is an elevational view of the bracket of FIG. 17.

FIGS. 17-19 show a bracket 71 with a right angle profile and in which the horizontal portion 21 has a lower section 72 offset towards the center of the inverted channel 23. This geometry, like that of the bracket 66 allows the lower section 72 to abut the web 14 of a grid runner 12 to align and stabilize the bracket and grid runner.

All of the disclosed brackets are characterized by a plate-like structure that fits closely against a grid runner and embossments or offsets of the same extend into the space above or below the reinforcing bulb of a grid runner so that lay-in ceiling panels can be installed and lifted for access without undue interference. Additionally, the various disclosed brackets are characterized by a vertically extending portion that rises above a standard 1½" grid runner or tee by more than 1½ times this height thereby allowing the bracket to sustain adequate levels of vertical force at the distal end of the horizontally extending portion.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. A seismic bracket for supporting the ends of suspended ceiling grid runners from a wall at the perimeter of the ceiling comprising a stamped sheet metal body, the body having a horizontally extending portion and a vertically extending portion, the vertically extending portion, in its installed position, rising above the top of a standard grid runner a distance at least 1½ times the height of such standard grid runner, the vertically extending portion having two sections generally coextensive with each other in the vertical direction and integrally joined with each other at discrete land locations separated by apertures along a vertical line substantially equal in length to the vertical extent of the vertically extending portion, a first section being integral with and generally coplanar with the horizontally extending portion and a second section arranged to be in a vertical plane that intersects a vertical plane occupied by the horizontally extending portion and the first section of the vertically extending portion, the horizontally extending portion including an elongated slot being arranged to support a grid runner with a screw assembled through the horizontally extending portion elongated slot and driven into the grid runner in a manner enabling the grid runner to move longitudinally a limited distance relative to the vertically extending portion, the second section of the vertically extending portion having a flat configuration and an aperture for securing the bracket to the wall at a location substantially above the grid tee, the first and second sections being separated at their lower ends by a lower aperture on said vertical line, said lower aperture being downwardly open whereby a lower portion of said second section is adapted to be installed behind a wall angle while a lower portion of said first section is disposed at the level of and directly in front of said wall angle, the first and second sections being joined at locations on said vertical line above their lower ends along a distance that is greater than the vertical extent of said lower aperture.

2. A bracket as set forth in claim 1, wherein the sheet material is weakened by the presence of said apertures along said vertical line between said first and second sections of said vertically extending portion enabling the second portion to be bent by hand force of an installer into a plane that intersects the plane of the first section.

3. A bracket as set forth in claim 1, wherein said horizontally extending portion has an inverted U-shaped channel proportioned to fit in the manner of a saddle over the reinforcing bulb of a standard grid tee.

4. A bracket as set forth in claim 1, wherein said vertically extending portion extends at least 1½ times higher than a standard grid runner in a plane parallel to the grid runner to which it is attached.

5. A bracket as set forth in claim 1, wherein said horizontally extending portion includes a depending pivotal support for attachment to a grid runner enabling the grid runner to move a limited longitudinal distance.

* * * * *